US008511375B2

(12) United States Patent
Hern et al.

(10) Patent No.: US 8,511,375 B2
(45) Date of Patent: Aug. 20, 2013

(54) WELLBORE CLEANING DEVICES

(75) Inventors: Gregory L. Hern, Porter, TX (US); Lisa L. Posevina, Cypress, TX (US); Paul L. Connell, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 379 days.

(21) Appl. No.: 12/772,313

(22) Filed: May 3, 2010

(65) Prior Publication Data

US 2011/0265988 A1 Nov. 3, 2011

(51) Int. Cl.
*E21B 37/02* (2006.01)
*E21B 37/00* (2006.01)

(52) U.S. Cl.
USPC ..... 166/173; 166/170

(58) Field of Classification Search
USPC ..... 166/173, 170, 172, 174, 175, 176, 166/177.3, 311, 241.7, 241.6
See application file for complete search history.

(56) References Cited

U.S. PATENT DOCUMENTS

| | | | | | |
|---|---|---|---|---|---|
| 1,809,975 | A | * | 6/1931 | Becker et al. | 408/164 |
| 2,312,600 | A | * | 3/1943 | Steps | 166/172 |
| 2,836,251 | A | * | 5/1958 | Claypool et al. | 166/173 |
| 2,936,031 | A | * | 5/1960 | Seago | 166/173 |
| 3,032,114 | A | * | 5/1962 | Best | 166/173 |
| 4,479,538 | A | * | 10/1984 | Coyle, Sr. | 166/173 |
| 4,558,738 | A | * | 12/1985 | Howard, Sr. | 166/173 |
| 4,648,447 | A | * | 3/1987 | Bishop et al. | 166/173 |
| 4,798,246 | A | * | 1/1989 | Best | 166/311 |
| 5,711,046 | A | * | 1/1998 | Potter | 15/104.2 |
| 5,829,521 | A | | 11/1998 | Brown, Jr. | 166/173 |
| 5,833,018 | A | * | 11/1998 | von Gynz-Rekowski | 175/325.3 |
| 5,947,203 | A | | 9/1999 | Brown, Jr. | 166/311 |
| 6,152,220 | A | * | 11/2000 | Carmichael et al. | 166/173 |
| 6,152,221 | A | * | 11/2000 | Carmichael et al. | 166/174 |
| 6,209,647 | B1 | | 4/2001 | Brown, Jr. | 166/311 |
| 6,227,291 | B1 | * | 5/2001 | Carmichael et al. | 166/170 |
| 6,460,616 | B1 | * | 10/2002 | Simpson | 166/104 |
| 6,464,010 | B1 | * | 10/2002 | Brown | 166/311 |
| 6,530,429 | B2 | * | 3/2003 | Howlett | 166/173 |
| 6,655,462 | B1 | * | 12/2003 | Carmichael et al. | 166/311 |
| 6,655,477 | B2 | * | 12/2003 | Appleton et al. | 175/325.3 |
| 6,851,472 | B2 | | 2/2005 | Hern et al. | 166/173 |
| 7,096,940 | B2 | * | 8/2006 | Baxter et al. | 166/241.6 |
| 7,255,164 | B2 | * | 8/2007 | Tulloch et al. | 166/173 |
| 7,311,141 | B2 | * | 12/2007 | Tulloch et al. | 166/173 |
| 7,513,303 | B2 | | 4/2009 | Hern | 166/173 |
| 7,559,374 | B2 | * | 7/2009 | Telfer | 166/311 |
| 7,878,238 | B2 | * | 2/2011 | Potter | 166/173 |

(Continued)

OTHER PUBLICATIONS

For the American Heritage Dictionary definition: affixed. (n.d.) The American Heritage® Dictionary of the English Language, Fourth Edition. (2003). Retrieved Apr. 30, 2013 from http://www.thefreedictionary.com/affixed.*

(Continued)

*Primary Examiner* — Nicole Coy
*Assistant Examiner* — Wei Wang
(74) *Attorney, Agent, or Firm* — Shawn Hunter

(57) ABSTRACT

A wellbore cleaning device having a unitary tool mandrel surrounded by a retaining sleeve that is rotatable with respect to the mandrel. A locking ring is used to secure the retaining sleeve to the mandrel. Cleaning blades are retained within recesses in the retaining sleeve and are biased radially outwardly from the recesses by springs.

24 Claims, 8 Drawing Sheets

(56) References Cited

U.S. PATENT DOCUMENTS

| | | | | |
|---|---|---|---|---|
| 2002/0139538 | A1* | 10/2002 | Young et al. | 166/380 |
| 2004/0011528 | A1* | 1/2004 | Howlett et al. | 166/311 |
| 2005/0082056 | A1* | 4/2005 | Baxter et al. | 166/241.6 |
| 2005/0205251 | A1* | 9/2005 | Tulloch et al. | 166/173 |
| 2006/0070731 | A1* | 4/2006 | Fouillou et al. | 166/241.4 |
| 2007/0246217 | A1* | 10/2007 | Tulloch et al. | 166/311 |
| 2007/0261855 | A1* | 11/2007 | Brunet et al. | 166/312 |
| 2008/0245523 | A1* | 10/2008 | Potter | 166/173 |
| 2009/0272524 | A1* | 11/2009 | Voth | 166/173 |
| 2010/0096121 | A1* | 4/2010 | Hettes | 166/173 |
| 2010/0181064 | A1* | 7/2010 | Knobloch et al. | 166/99 |
| 2010/0186962 | A1* | 7/2010 | Knobloch et al. | 166/311 |
| 2011/0214873 | A1* | 9/2011 | Krieg et al. | 166/311 |
| 2011/0253376 | A1* | 10/2011 | Krpec | 166/311 |

OTHER PUBLICATIONS

For the American Heritage Dictionary definition: with. (n.d.) The American Heritage® Dictionary of the English Language, Fourth Edition. (2003). Retrieved Apr. 30, 2013 from http://www.thefreedictionary.com/with.*

* cited by examiner

FIG. 8
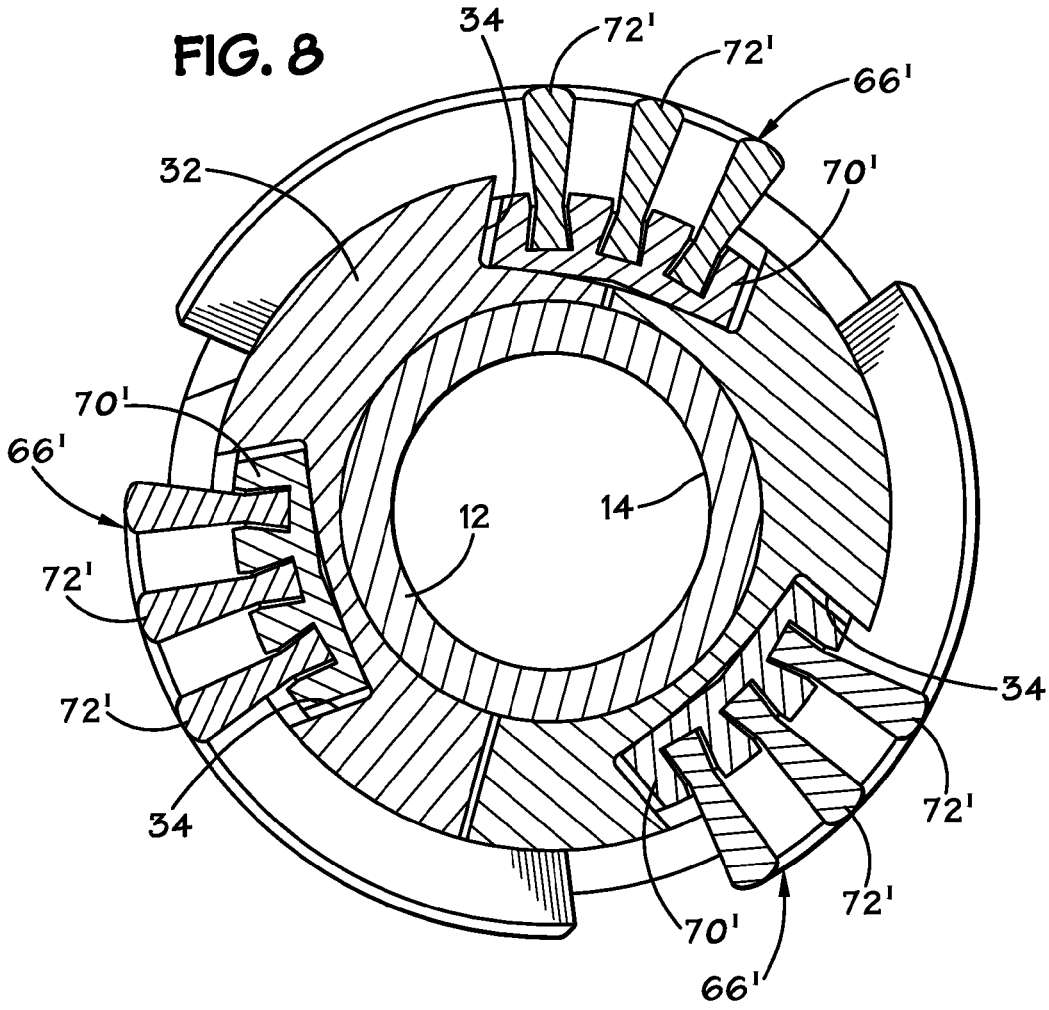
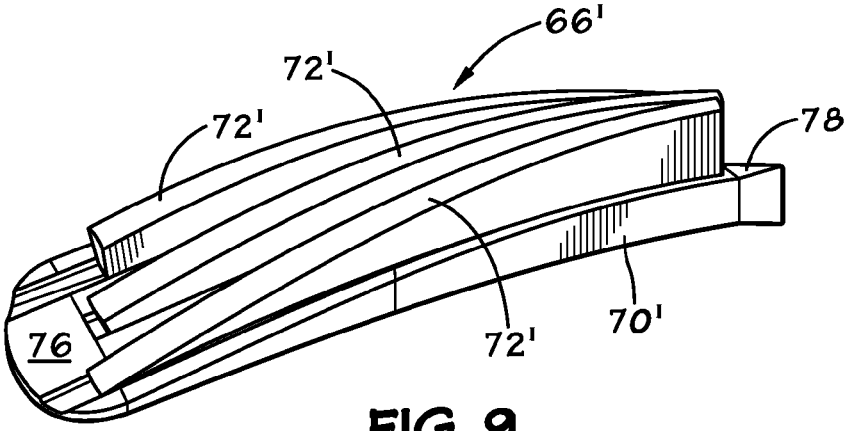
FIG. 9

WELLBORE CLEANING DEVICES

BACKGROUND OF THE INVENTION

1. Field of the Invention

The invention relates generally to systems and methods for cleaning the interior of tubular members. In particular aspects, the invention relates to methods and devices for scraping wellbore casing.

2. Description of the Related Art

Wellbore cleaning devices include casing scrapers and brushing devices. These mechanisms are used to remove mud, cement sheath, perforation burrs, rust, scale, paraffin, and other debris from the internal surface of wellbore casing. The casing scraper or brush is typically attached to a drill string for operation. The drill string and cleaning device are then disposed within the casing members to be scraped, and rotated.

Typical casing scrapers include a central scraping body and one or more scraping blades that extend radially outwardly therefrom. Conventional casing scrapers generally fall into one of two categories: rotating and non-rotating. With a rotating scraper, the scraping body and the scraping blades are securely affixed to each other so that both rotate with the drill string. In applications where the drill string is rotated for long periods of time, rotating scrapers can cause serious wear and damage to the interior surface of casing. With a non-rotating scraper, only the scraping body rotates with the drill string. The scraper blades are not affixed to the central scraping body, but are urged radially outwardly from it by compression springs in order to provide a force for removal of debris. An example of this type of arrangement is found in U.S. Pat. No. 7,311,141 issued to Tulloch et al.

SUMMARY OF THE INVENTION

The invention provides methods and devices for cleaning the interior of tubular members, such as casing members. Exemplary non-rotating tubular cleaning devices are described which include a unitary central tool mandrel with radially surrounding stabilizers and a blade retainer sleeve and one or more cleaning blades that are retained within recesses on the blade retainer sleeve. In a described embodiment, the cleaning blades are scraper blades that are disposed within and biased radially outwardly from the recesses. A brush-type wellbore cleaning blade or a magnetic cleaning blade could also be used.

The construction of cleaning devices in accordance with the present invention permit these tools to have improved strength and resistance to axial and torsional forces within the work string within which the cleaning device is used. The threaded connection of the tool mandrel to other components in a tool string largely governs the strength of the tool overall. The cleaning tools of the present invention utilize a unitary tool mandrel which provides for greater overall tool strength.

The blade retainer is preferably a split sleeve, or a sleeve made up of multiple arcuate components, that is secured around the mandrel. In one embodiment, the blade retainer is made up of two retainer sleeve halves. The retainer sleeve halves mate with one another to form a complete annular sleeve that surrounds the mandrel. The blade retainer serves to permit the mandrel to move radially with respect to the cleaner blades.

In a further preferred embodiment, the blade retainer is secured around the mandrel by a locking ring. The locking ring is preferably also made up of multiple arcuate components that mate with one another to form a complete annular ring. The locking ring presents a radial profile that interlocks with a complimentary profile on the blade retainer. The locking ring and blade retainer are installed onto the mandrel by engaging each locking ring component with one of the blade retainer components. The locking ring components and blade retainer components are then placed in surrounding location around the mandrel. Then the locking ring is rotated with respect to the blade retainer so that the breaks between the locking ring components are not aligned with the breaks between the blade retainer components.

The cleaning device uses cleaning blades which are often in the form of scraper blades. However, brushes and magnets may also be used as the cleaning blades. In preferred embodiments, the cleaning blades have an elongated cleaning blade body which has a twist along its length. As a result, one axial end of the cleaning blade is angularly offset from the other axial end of the blade. The side of the blade provides a sharp edge for cleaning the casing. The end-to-end angular offset for each blade provides overall lap with other blades so that the entire circumference of the tubular is cleaned by the sides of the scraper blades. The axial ends of each cleaning blade preferably present engagement portions by which the blade is engaged and retained upon the tool mandrel.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein:

FIG. 8 is an axial cross-section taken along lines 8-8 in FIG. 7.

FIG. 9 is an isometric view of a single cleaning blade from the device shown in FIGS. 6-9, shown apart from the other components of the cleaning device.

DETAILED DESCRIPTION OF THE PREFERRED EMBODIMENTS

Figure 1:
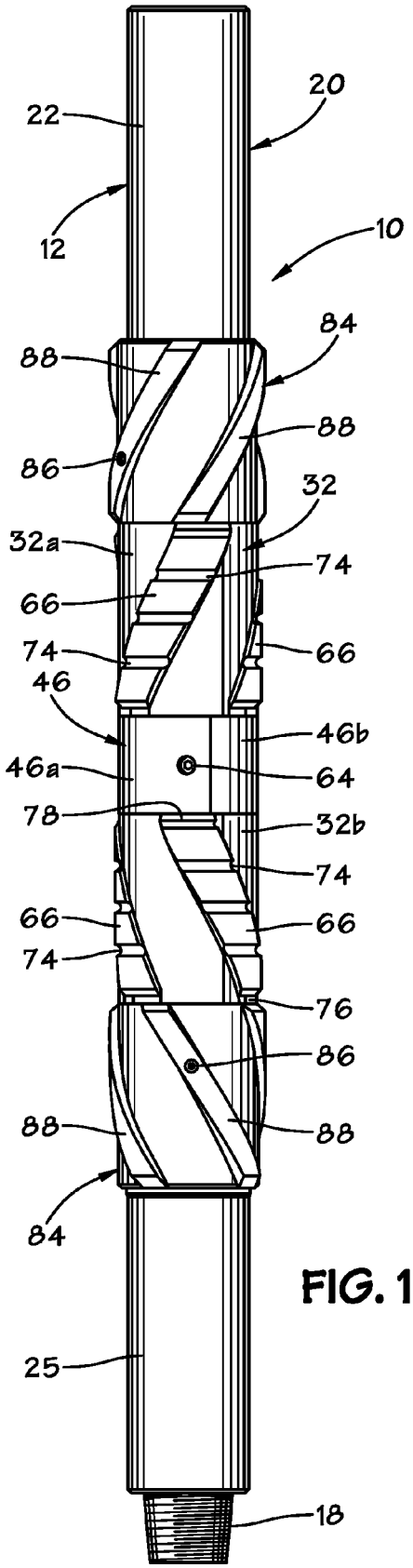
FIG. 1 is a side, external view of an exemplary wellbore cleaning device constructed in accordance with the present invention.

FIGS. 1-4 illustrate an exemplary wellbore cleaning device 10 that is constructed in accordance with the present invention. The cleaning device 10 is a tubular scraper device or tool 10 that is useful for incorporation into a wellbore work string and disposed within a wellbore. The cleaning device 10 includes a generally cylindrical tool mandrel, generally indicated at 12. The tool mandrel 12 defines a central flowbore 14 along its length. The upper end of the tool mandrel 12 preferably includes a box-type threaded connection 16 so that the cleaning device 10 may be secured to other portions of a wellbore work string (not shown). The lower end of the tool mandrel 12 includes a pin-type threaded connection 18.

Preferably, the tool mandrel 12 is unitarily-formed and of a single piece. There are no separate components threaded together to make up the tool mandrel 12, which provides it with significant strength and resiliency in use. The tool mandrel 12 presents an outer radial surface 20 having a number of different diameter portions. There is an upper, enlarged-diameter portion 22, a middle, reduced-diameter portion, generally shown at 24, and a lower, enlarged-diameter portion 25. The middle reduced-diameter portion 24 includes an indented portion 26 which has a smaller diameter. Raised shoulders 28, 30 are located at either axial end of the indented portion 26.

A blade retainer sleeve 32 radially surrounds the tool mandrel 12. The blade retainer sleeve 32 is generally cylindrically-shaped and presents a number of external recesses 34 on its outer radial surface. In the depicted embodiment, the blade retainer sleeve 32 is made up of two, generally semicircular retainer sleeve halves 32*a*, 32*b*. The sleeve halves 32*a*, 32*b* mate with each other to form a substantially complete annular sleeve surrounding the mandrel 12. It is noted that, in alternative embodiments, the retainer sleeve 32 may be formed of three, four or more separate sleeve portions, if desired, so long as, when assembled the sleeve portions form a substantially complete annular sleeve surrounding the mandrel 12. It is also noted that the retainer sleeve 32, when surrounding the middle, reduced-diameter portion 24 of the tool mandrel 12, is trapped axially between the upper and lower enlarged-diameter portions 22, 25.

The outer radial surface of the blade retainer sleeve 32 includes a locking profile 36. In the depicted embodiment, the locking profile 36 is formed into the exterior radial surface of the sleeve 32. The profile 36 includes an outer portion 38 that provides axially-extending lateral platforms and an inner portion 40 that is a channel with a widened inner base. However, other suitable cross-sectional shapes may be used.

Figure 2:
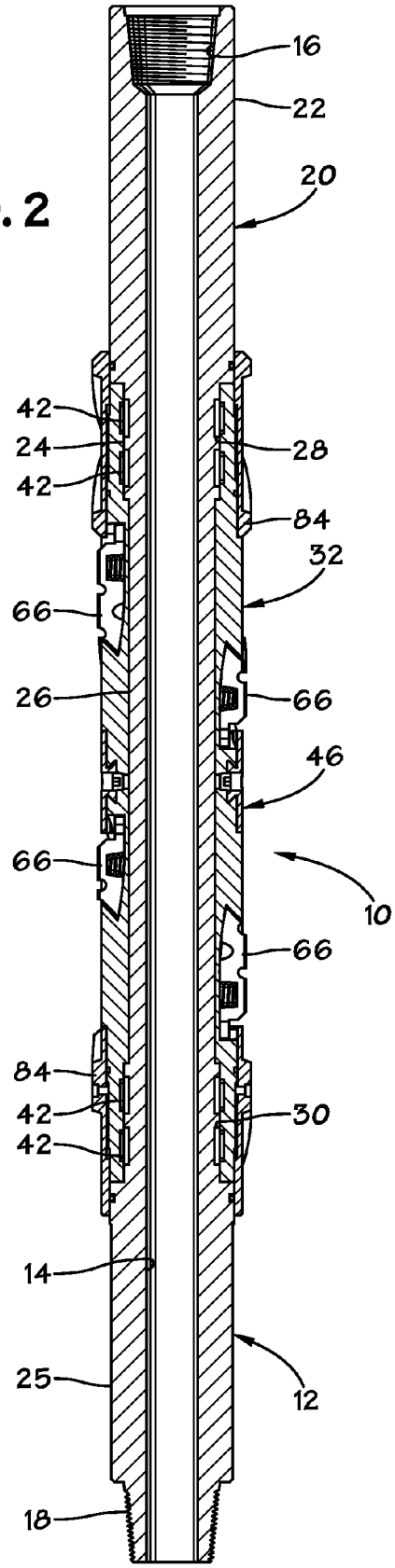
FIG. 2 is a side, cross-sectional view of portions of the cleaning device shown in FIG. 1.
Figure 3:
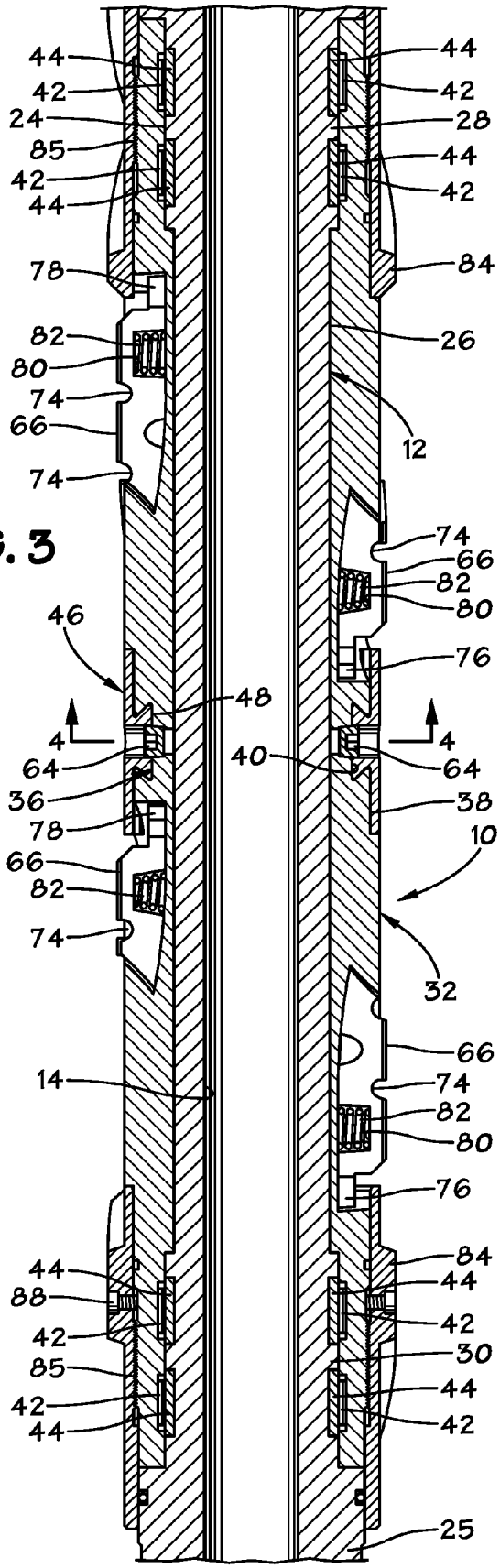
FIG. 3 is a closer side, cross-sectional view of portions of the cleaning device shown in FIGS. 1-2.
Figure 3A:
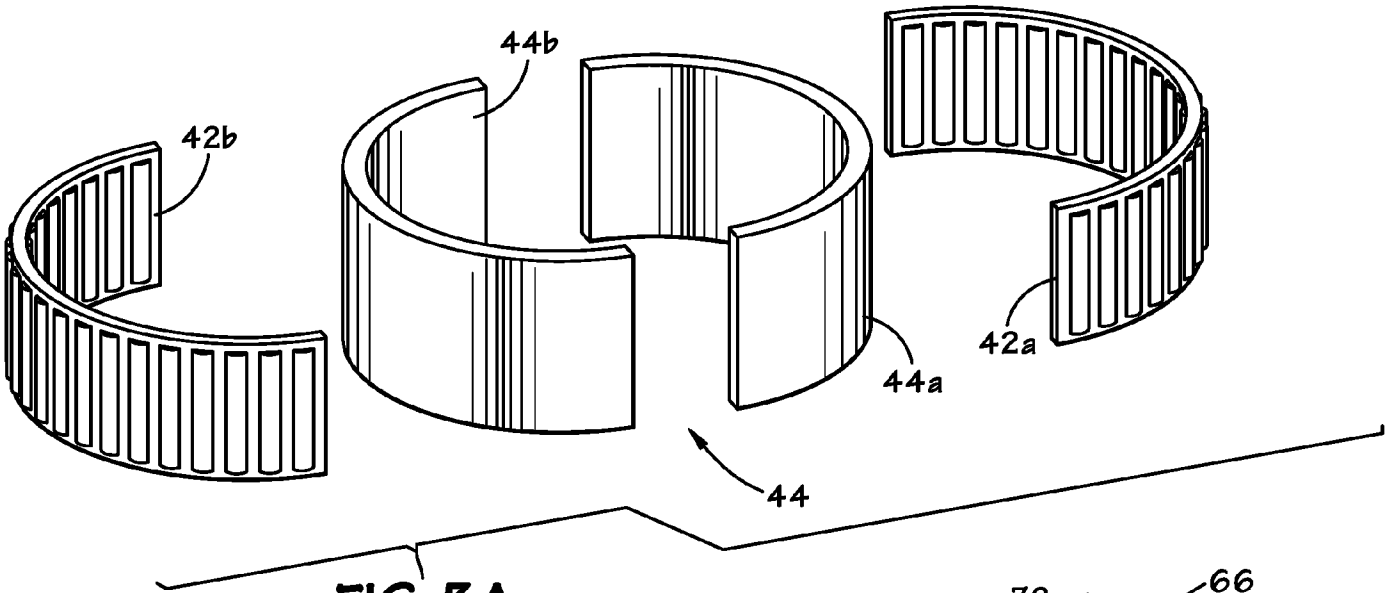
FIG. 3A is an exploded, isometric view of the split needle roller bearing and split ring insert.

Referring to FIGS. 2 and 3, bearings 42 are disposed between the blade retainer sleeve 32 and the mandrel 12. Needle-type roller bearings are suitable for use as the bearings 42 as well as other suitable bearings, such as full-compliment roller bearings, full-compliment ball bearings or bushings. Polished split ring inserts 44 are disposed around the raised shoulders 28 and 30 of the middle reduced-diameter portion 24. As shown in FIG. 3A, the split ring inserts 44 are each formed of two arcuately curved, generally semi-cylindrical split ring halves 44*a* and 44*b*, which can be assembled around the mandrel 12 to form a substantially complete annular ring insert 44. The roller bearings 42 are in contact with and roll upon the inserts 44. Also as shown in FIG. 3A, the roller bearings 42 are preferably made up of two arcuately curved, generally semi-cylindrical roller bearing halves 42*a*, 42*b* and are assembled about the mandrel 12 to form a complete circular bearing. The roller bearings 42 and inserts 44 permit the blade retainer sleeve 32 to rotate about the mandrel 12.

Figure 4:
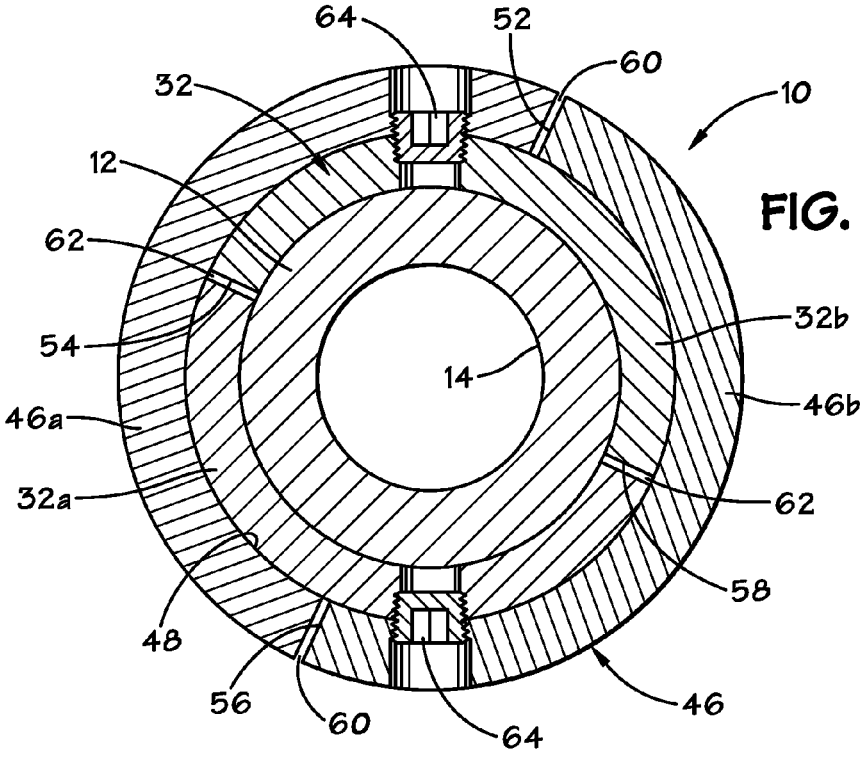
FIG. 4 is an axial cross-section taken along lines 4-4 in FIG. 3.
Figure 4A:
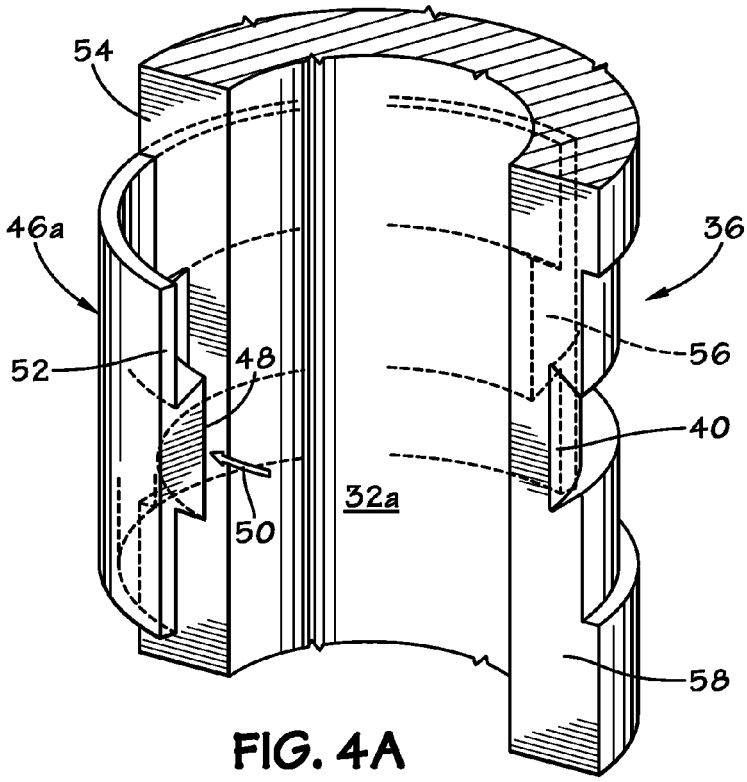
FIG. 4A is an isometric view depicting the insertion of a locking ring portion into the locking profile of a blade retaining sleeve portion.
Figure 6:
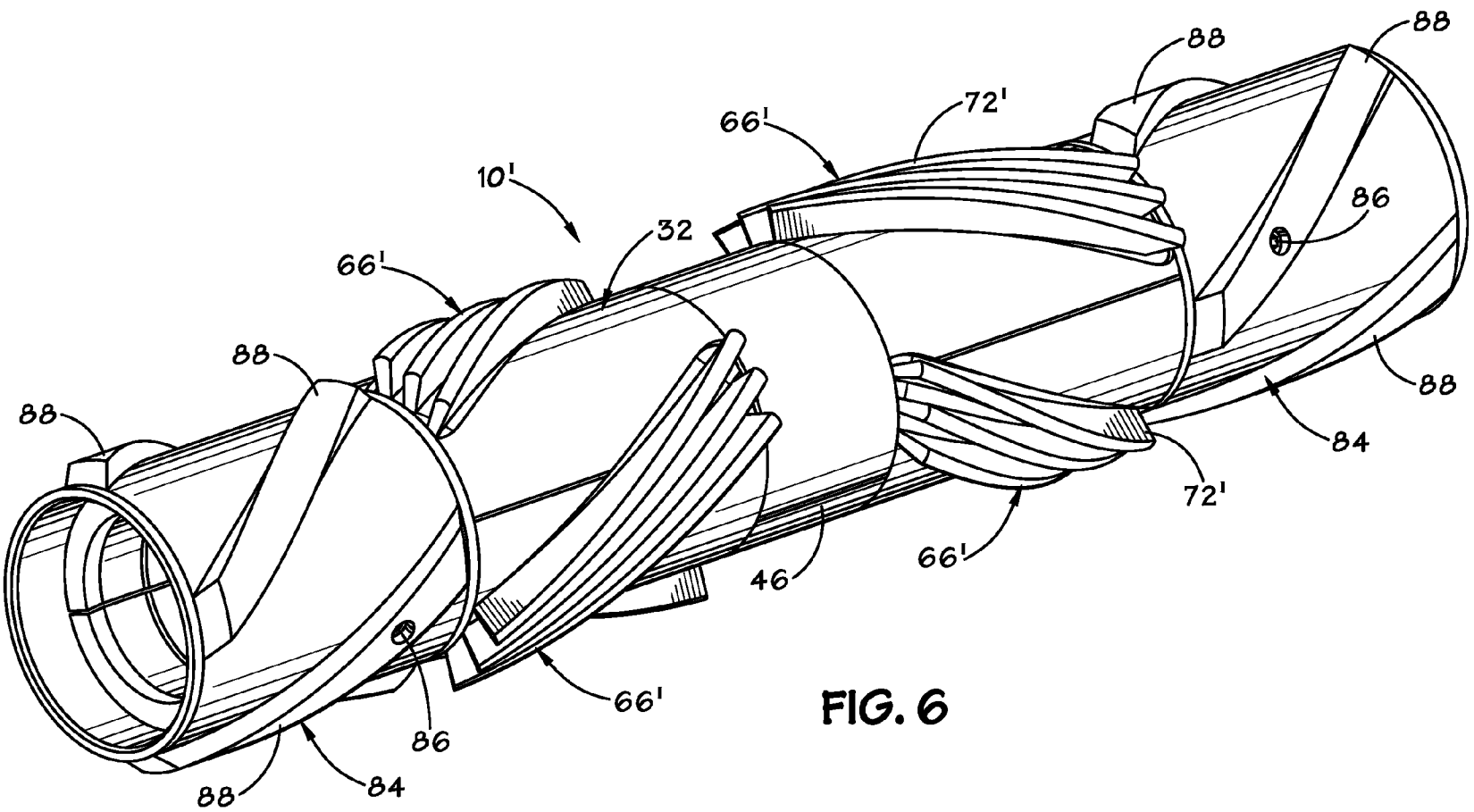
FIG. 6 is an external, isometric view of an alternative cleaning or brush device constructed in accordance with the present invention.
Figure 7:
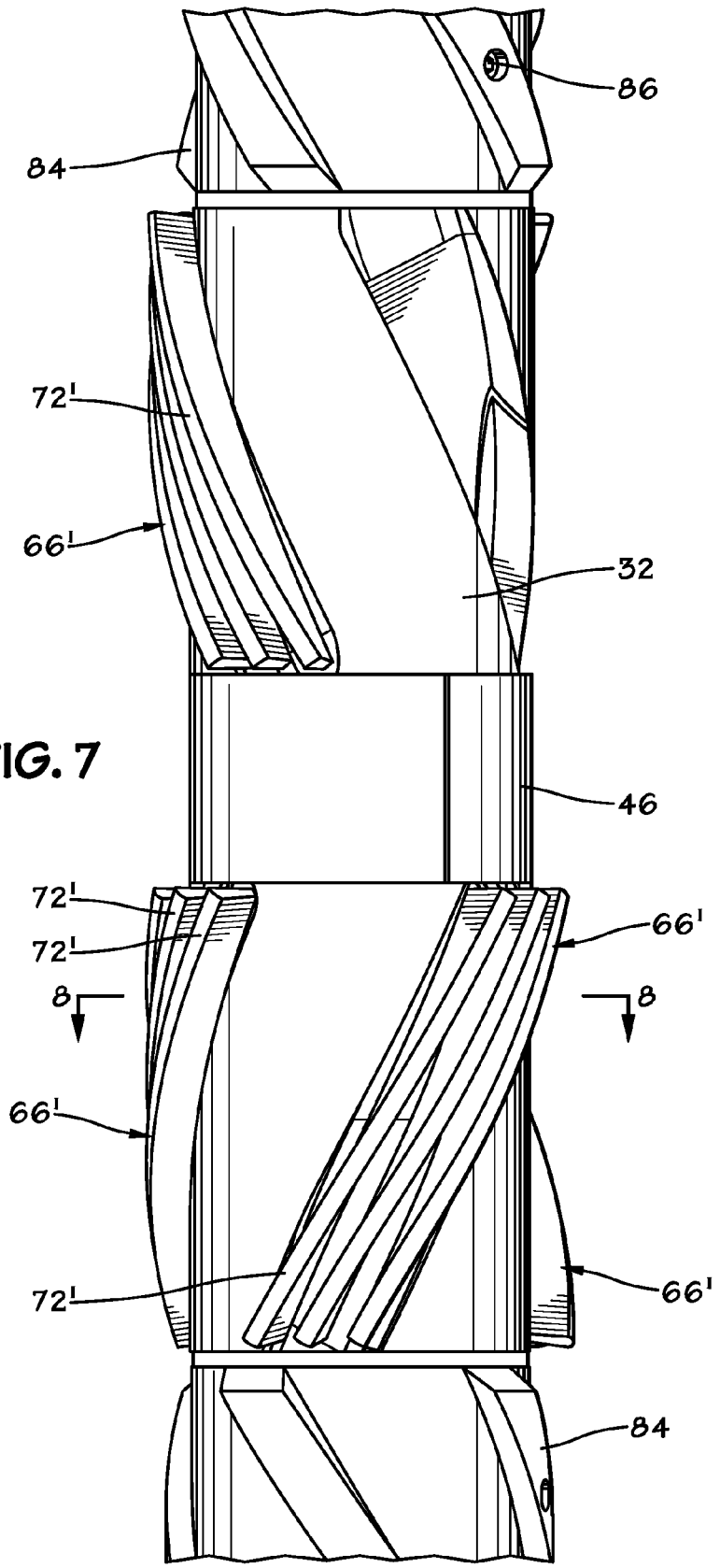
FIG. 7 is a side, external view of portions of the cleaning device shown in FIG. 6.

A locking ring 46 is used to secure the blade retainer sleeve 32 to the mandrel 12. In the depicted embodiment, the locking ring 46 is made up of two arcuately curved, generally semi-cylindrical ring portions 46*a*, 46*b*, as can be seen in FIGS. 1 and 4. Each of the ring portions 46*a*, 46*b* preferably presents an inner radial surface with a key 48 that is shaped to fit in a complimentary manner within the locking profile 36 of the blade retainer sleeve 32. As best seen in FIGS. 3 and 4A, the key 48 is shaped as an inwardly-projecting ridge with widened lateral sides which will slide into the inner channel portion 40 of the locking profile 36.

In order to assemble the blade retainer sleeve 32 and the locking ring 46 about the tool mandrel 12, each locking ring portion 46*a* or 46*b* is inserted into the locking profile 36 of a blade retainer sleeve portion 32*a* or 32*b*. FIG. 4A illustrates the insertion of locking ring portion 46*a* into the locking profile 36 of the blade retainer sleeve portion 32*a*. As can be seen, the key 48 of the locking ring portion 46*a* is inserted into the inner channel portion 40 of the locking profile 36. The locking ring portion 46*a* is then slid in the direction of arrow 50 until semi-circular edge 52 of the locking ring portion 46*a* is substantially aligned with the edge portion 54 of the blade retainer sleeve portion 32*a*. When this alignment occurs, the other semi-circular edge 56 of the locking ring portion 46*a* becomes substantially aligned with the other edge 58 of the blade retainer sleeve portion 32*a*. The same insertion and alignment is then performed with the other blade retainer sleeve portion 32*b* and the other locking ring portion 46*b*.

Thereafter, the two blade retainer sleeve portions 32*a* and 32*b* and locking ring portions 46*a*, 46*b* are placed upon either side of the tool mandrel 12 so that the tool mandrel 12 is substantially surrounded by the blade retainer sleeve 32 and locking ring 46. Then the locking ring 46 is rotated with respect to the blade retainer sleeve 32 until the gaps 60 (see FIG. 4) between the locking ring portions 46*a*, 46*b* are offset from the gaps 62 between the blade retainer sleeve portions 32*a*, 32*b*. When this is done, the two blade retainer sleeve portions 32*a*, 32*b* are secured together by the locking ring 46. Locking screws 64 are inserted through the locking ring portions 46*a* and 46*b* and into the blade retainer sleeve portions 32*a*, 32*b*, as depicted in FIG. 4, thereby securing the locking ring portions 46*a*, 46*b* to the retainer sleeve portions 32*a*, 32*b*.

Figure 5:
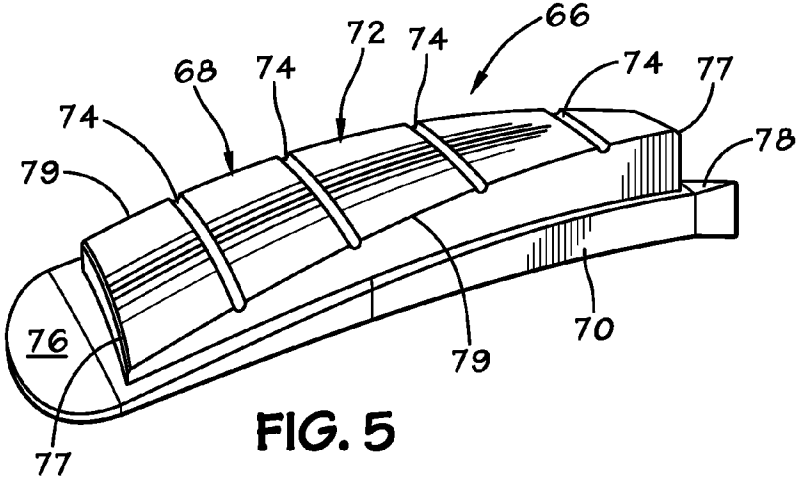
FIG. 5 is an isometric view of a single scraper blade from the device shown in FIGS. 1-4, shown apart from the other components of the scraper device.

Cleaning blades 66 are disposed within each of the recesses 34 of the blade retainer sleeve 32. Cleaning blades used with the cleaning device 10 are often in the form of scraper blades. However, they may also be brushes or magnets useful for cleaning wellbores. FIG. 5 depicts a single exemplary scraper-type cleaning blade 66 apart from the other components of the cleaning device 10. The cleaning blade 66 has an elongated cleaning blade body 68 which is made up of a base portion 70 and an outwardly projecting blade portion 72. In this instance, the blade portion 72 is substantially rectangular and presents radially-extending grooves 74 upon the outer surface. The blade body base portion 70 presents two axial end engagement portions 76 and 78 from which no blade portion 72 projects. The engagement portions 76, 78 are useful for retaining the cleaning blades 66 within the recesses 34 of the blade retainer sleeve 32, as will be described shortly. The ends 77 of the cleaning blades 66 are beveled so that the blades will slide past a shoulder that may be encountered in the surrounding wellbore or tubular. The sides of the cleaning blades 66 provide a sharp corner 79 to efficiently remove debris attached to the inside of the surrounding wellbore or tubular. It is noted that a twist is formed along the length of the body 68 so that the axial end 76 is oriented in an angularly offset manner from the other axial end 78. In a currently preferred embodiment, the two ends 76, 78 are angularly offset from one another so that the sides of the blades 66 clean the entire circumference of the surrounding wellbore or tubular. In addition to the angular offset, the blade body base portion 70 is shaped and sized to reside within a recess 34 of the blade retainer sleeve 32 in a complimentary manner.

The underside of each cleaning blade 66 provides a spring recess 80 (see FIG. 3). Compression springs 82 are disposed within each of the spring recesses 80 and serve to resiliently bias the cleaning blades 66 radially outwardly from the blade retainer sleeve 32.

The cleaning blades 66 are retained within the recesses 34 of the blade retainer sleeve 32 by the locking ring 46 and stabilizers 84. As can be seen in FIGS. 1 and 3, one of the engagement portions 76, 78 of each cleaning blade 66 underlies either the locking ring 46 or one of the stabilizers 84. The other of the engagement portions 76, 78 underlies the other of the locking ring 46 or a stabilizer 84. The stabilizers 84 radially surround the tool mandrel 12 and a portion of the blade retainer sleeve 32. The stabilizers 84 are secured to the blade retainer sleeve 32 by threaded connections 85, visible in FIG. 3. Set screws 86 are used to secure the stabilizers in place upon the blade retainer sleeve 32. The stabilizers 84 present outwardly-projecting ribs 88 for contacting a surrounding tubular member in order to keep the cleaning device 10 centralized within the surrounding tubular during operation.

FIGS. 6-9 depict an alternative cleaning device 10' which is also constructed in accordance with the present invention. The cleaning device 10' is constructed in the same manner as the cleaning device 10 except where otherwise indicated. The exemplary cleaning device 10' uses brush blades 66' which are made up of a blade body base portion 70' and three outwardly projecting brush portions 72'. The brush portions 72' extend from one axial end portion 76 to the other axial end portion 78. The blade body base 70' and the brush portions 72' are each formed to provide a twist along their length. As with the scraper blade 66 described previously, the axial end 76 is oriented in an angularly offset manner from the other axial end 78. In a currently preferred embodiment, the two ends 76, 78 are angularly offset from one another so that the brush portions 72' clean the entire circumference of the tubular.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A wellbore cleaning device comprising:

a unitarily-formed tool mandrel;

a retaining sleeve radially surrounding the tool mandrel and radially rotatable about the mandrel, the retaining sleeve being formed of multiple separate retaining sleeve portions that are assembled around the tool mandrel to form a substantially complete annular sleeve, the retaining sleeve being secured to the tool mandrel to rotate thereupon;

at least one cleaning member mounted upon said retaining sleeve for cleaning a surrounding tubular member; and an annular member radially surrounding the retaining sleeve portions and affixed to the retaining sleeve portions so that the annular member rotates together with the retaining sleeve.

2. The wellbore cleaning device of claim 1 further comprising one or more bearings disposed between the retaining sleeve and the tool mandrel, the bearing being formed of multiple arcuately curved bearing portions that are assembled around the tool mandrel to form a substantially complete annular bearing.

3. The wellbore cleaning device of claim 2 wherein the one or more bearings provide rotation between the retaining sleeve and the tool mandrel and are selected from a group consisting of: a needle-type roller bearing, a bushing, full-compliment roller bearings, and full-compliment ball bearings.

4. The wellbore cleaning device of claim 1 wherein the retaining sleeve is secured around the tool mandrel by a locking ring.

5. The wellbore cleaning device of claim 4 wherein:

the retaining sleeve presents a locking profile; and the locking ring has a key that is shaped and sized to engage the locking profile in a complimentary manner.

6. The wellbore cleaning device of claim 1 wherein the locking ring is formed of multiple arcuately curved ring portions that are assembled around the tool mandrel to form a substantially complete annular locking ring.

7. The wellbore cleaning device of claim 1 wherein the annular member comprises a stabilizer.

8. The wellbore cleaning device of claim 1 wherein the cleaning member comprises a scraper blade.

9. The wellbore cleaning device of claim 1 wherein the cleaning member comprises a brush.

10. The wellbore cleaning device of claim 1 wherein the cleaning member is retained within a recess formed within the retaining sleeve.

11. The wellbore cleaning device of claim 10 wherein the cleaning member is biased radially outwardly from the recess of the retaining sleeve by a spring that is disposed between the cleaning member and the recess.

12. The wellbore cleaning device of claim 11 wherein the spring is a compression spring.

13. The wellbore cleaning device of claim 10 wherein the cleaning member is retained within the recess by disposing an engagement portion of the cleaning member beneath a locking ring which radially surrounds the retaining sleeve.

14. The wellbore cleaning device of claim 1 wherein the cleaning member comprises a body having first and second axial ends and wherein an angular twist is formed along the length of the body such that the first axial end is oriented in an angularly offset manner from the second axial end.

15. The wellbore cleaning device of claim 14 wherein the angular offset permits the sides of the cleaning members to clean the entire circumference of the surrounding tubular member.

16. A wellbore cleaning device comprising:

a tool mandrel;

a retaining sleeve radially surrounding the tool mandrel and radially rotatable about the mandrel, the retaining sleeve being formed of multiple separate retaining sleeve portions that are substantially assembled within a reduced-diameter portion of the tool mandrel to form a substantially complete annular sleeve, the retaining sleeve being secured to the tool mandrel to rotate thereupon;

at least one cleaning member mounted upon said retaining sleeve for cleaning a surrounding tubular member, the cleaning member being biased radially outwardly from the retaining sleeve by a spring; and an annular member radially surrounding the retaining sleeve portions and affixed to the retaining sleeve portions so that the annular member rotates together with the retaining sleeve.

17. The wellbore cleaning device of claim 16 wherein:

the retaining sleeve presents a locking profile; and the cleaning device further comprises a locking ring radially surrounding the retaining sleeve and having a key that is shaped and sized to engage the locking profile in a complimentary manner.

18. The wellbore cleaning device of claim 17 wherein the locking ring is formed of multiple arcuately curved ring portions that are assembled around the tool mandrel to form a substantially complete annular locking ring.

19. The wellbore cleaning device of claim 18 wherein the cleaning member is retained within the reduced-diameter portion by disposing an engagement portion of the cleaning member beneath a locking ring which radially surrounds the retaining sleeve.

20. The wellbore cleaning device of claim 16 wherein the cleaning member comprises a scraper blade.

21. The wellbore cleaning device of claim 16 wherein the cleaning member comprises a brush.

22. A wellbore cleaning device comprising:

a unitarily-formed tool mandrel a retaining sleeve radially surrounding the tool mandrel and radially rotatable about the mandrel, the retaining sleeve being formed of multiple separate retaining sleeve portions that are assembled around the tool mandrel to form a substantially complete annular sleeve, the retaining sleeve being secured to the tool mandrel to rotate thereupon;

at least one cleaning member mounted upon said retaining sleeve for cleaning a surrounding tubular member, the cleaning member being biased radially outwardly from the retaining sleeve by a spring;

a locking ring radially surrounding the retaining sleeve, the locking ring being formed of multiple arcuately curved ring portions that are assembled around the tool mandrel to form a substantially complete annular locking ring to retain an end of a cleaning member within a recess in the retaining sleeve; and an annular member radially surrounding the retaining sleeve portions and affixed to the retaining sleeve portions so that the annular member rotates together with the retaining sleeve.

23. The wellbore cleaning device of claim 22 wherein the cleaning member comprises a blade body having first and second axial ends and wherein an angular twist is formed along the length of the blade body such that the first axial end is oriented in an angularly offset manner from the second axial end.

24. The wellbore cleaning device of claim 23 wherein the angular offset permits the sides of the cleaning members clean an entire circumference of the surrounding tubular member.

* * * * *